US008355651B2

(12) United States Patent
Lee et al.

(10) Patent No.: US 8,355,651 B2
(45) Date of Patent: Jan. 15, 2013

(54) IMAGE FORMING APPARATUS

(75) Inventors: Sung Kyun Lee, Seoul (KR); Myoung Sub Jang, Suwon-si (KR); Gi Cheol Jeong, Suwon-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 614 days.

(21) Appl. No.: 12/533,016

(22) Filed: Jul. 31, 2009

(65) Prior Publication Data

US 2010/0046979 A1 Feb. 25, 2010

(30) Foreign Application Priority Data

Aug. 19, 2008 (KR) ..... 10-2008-0080761

(51) Int. Cl.
*G03G 21/18* (2006.01)

(52) U.S. Cl. ..... 399/114

(58) Field of Classification Search ..... 399/110, 399/114, 124

See application file for complete search history.

(56) References Cited

U.S. PATENT DOCUMENTS

2006/0120746 A1* 6/2006 Lee et al. ..... 399/90
2006/0180995 A1* 8/2006 Izumi et al. ..... 271/145

FOREIGN PATENT DOCUMENTS

JP 2003-287987 10/2003

* cited by examiner

*Primary Examiner* — Walter L Lindsay, Jr.
*Assistant Examiner* — Barnabas Fekete
(74) *Attorney, Agent, or Firm* — Stanzione & Kim, LLP

(57) ABSTRACT

An image forming apparatus includes a power interrupting structure and a cover opening and closing structure. The image forming apparatus includes an apparatus body, a first cover and a second cover to open and close the apparatus body, a switch configured to be turned on/off according to an opening and closing operation of the first cover, and a safety device, operatively connected to the second cover, to selectively restrict the switch from being turned on by the first cover.

25 Claims, 8 Drawing Sheets

IMAGE FORMING APPARATUS

CROSS-REFERENCE TO RELATED APPLICATIONS

This application claims priority under 35 U.S.C. 119 from Korean Patent Application No. 2008-0080761, filed on Aug. 19, 2008 in the Korean Intellectual Property Office, the disclosure of which is incorporated herein by reference in its entirety.

BACKGROUND

1. Field of the Invention

The present general inventive concept relates to an image forming apparatus, and more particularly, to an image forming apparatus of which a power interrupting structure and a cover opening and closing structure are improved.

2. Description of the Related Art

An image forming apparatus forms an image on print media according to a signal inputted thereto. The image forming apparatus includes a printer, a copier, a facsimile, and a multifunction machine with integrated functions thereof.

An electrophotograph type image forming apparatus scans light on a photoconductor charged with a predetermined electric potential to form an electrostatic latent image on the surface of the photoconductor, and supplies a developing agent to the latent image, using a developing unit, to develop into a visible image. The visible image, developed on the photoconductor, is directly transferred to print media, or is transferred to the print media via an intermediate transfer unit. The image, transferred to the print media, is fused to the print media through a fusing process. The developing agent may not be transferred to the print media or the intermediate transfer unit but left on the photoconductor during the transferring process. The residual developing agent is collected by a cleaning unit, and is then stored in a developing agent storage unit.

Also, the image forming apparatus further includes a plurality of covers provided at an apparatus body and at least one switch configured to be turned on/off according to the opening and closing operation of the covers.

SUMMARY

The present general inventive concept provides an image forming apparatus of which a power interrupting structure and a cover opening and closing structure are improved.

Additional aspects and utilities of the present general inventive concept will be set forth in part in the description which follows and, in part, will be obvious from the description, or may be learned by practice of the general inventive concept.

According to embodiments and utilities of the present general inventive concept, there is provided an image forming apparatus including an apparatus body, a first cover and a second cover to open and close the apparatus body, a switch configured to be turned on/off according to an opening and closing operation of the first cover, and a safety device, operatively connected to the second cover, to selectively restrict the switch from being turned on by the first cover.

The switch may be turned on by the closing operation of the first cover, and the safety device may restrict the closing operation of the first cover in a state in which the second cover is open.

The safety device may selectively restrict a rotation of the first cover.

The safety device may be operatively connected to the second cover to perform a rectilinear motion.

The safety device may advance from the apparatus body when the second cover is opened, and the safety device may retreat to the apparatus body when the second cover is closed.

The apparatus body may include a guide to guide the rectilinear motion of the safety device.

The safety device may be operatively connected to the second cover to perform a rotation.

The safety device may include a device body and a support part provided at an upper side of the device body to selectively support the first cover.

The image forming apparatus may further include an anti-vibration member, made of an elastic material, attached to an end of the support part.

The support part may be elastically supported by the body part.

The image forming apparatus may further include a back-and-forth moving link operatively connected to the second cover to perform a back-and-forth motion. The safety device may further include an incline part provided at a lower side of the device body to slide along a lifter of the back-and-forth moving link.

The image forming apparatus may further include a developing device having at least one driven shaft and at least one coupling selectively connected to the at least one driven shaft of the developing device. A connection between the at least one driven shaft of the developing device and the at least one coupling may be achieved or released by the back-and-forth motion of the back-and-forth moving link.

The image forming apparatus may further include a rotary link, having one end connected to the second cover and the other end connected to the back-and-forth moving link, to transmit a rotary force of the second cover to the back-and-forth moving link.

The image forming apparatus may further include a damping member connected to the back-and-forth moving link and the rotary link to damp a rotation of the second cover.

Power supplied to a drive device may be turned on/off by the switch.

According to embodiments and utilities of the present general inventive concept, there is also provided an image forming apparatus including an apparatus body, a first cover and a second cover to open and close the apparatus body, a drive device to which power is supplied or the supply of power is interrupted according to the an opening and closing operation of the first cover, and a safety device configured to restrict a rotation of the first cover, in a state in which the second cover is open, to prevent power from being supplied to the drive device.

The safety device may be operatively connected to the second cover.

The image forming apparatus may further include a first link having one end hingedly coupled to the second cover, a second link having one end hingedly coupled to the other end of the first link to perform a rotation, a third link connected to the other end of the second link to perform a back-and-forth motion, and a fourth link connected to the third link to perform an up-and-down motion. The safety device may slide along a lifter provided at the third link to move upward and downward.

The image forming apparatus may further include an attaching and detaching member configured to be attached to or detached from the apparatus body and a coupling selectively connected to the attaching and detaching member. The coupling may be connected to the fourth link.

The image forming apparatus may further include a switch configured to be pushed by the first cover to be turned on/off.

According to embodiments and utilities of the present invention general inventive concept, there is also provided an image forming apparatus including an apparatus body, a first cover and a second cover to open and close the apparatus body, a switch configured to be turned on/off according to an opening and closing operation of the first cover, a drive device to which power is supplied or the supply of power is interrupted according to the an opening and closing operation of the first cover, and a safety device, operatively connected to the second cover, to selectively restrict the switch from being turned on by the first cover.

According to embodiments and utilities of the present invention general inventive concept, there is also provided an image forming apparatus including an apparatus body, a first cover and a second cover to open and close the apparatus body, and a safety device configured to restrict a movement of one of the first cover and the second cover when the other one of the first cover and the second cover is open.

According to embodiments and utilities of the present invention general inventive concept, there is also provided an image forming apparatus including an apparatus body having one or more openings and one or more units disposed therein to form an image on a printing medium, a first cover and a second cover to open and close the one or more openings of the apparatus body to allow a user to access at least one of the one or more units through the one or more openings, a drive device to supply power to at least one of the one or more units, and a link unit to move according to movements of the first cover and the second cover, and to control the drive device to selectively supply the power.

The image forming apparatus may further include a switch disposed to selectively operate according to the movement of the link unit; and a safety device disposed between the switch and the one of the first cover and the second cover to control a communication between the switch and the one of the first cover and the second cover.

In the image forming apparatus, one of the one or more units may be disposed on the one of the first cover and the second cover and moves together with the one of the first cover and the second cover between an operating position where the units forms the image and a non-operating position where the units do not form the image.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE EMBODIMENTS

Figure 1:
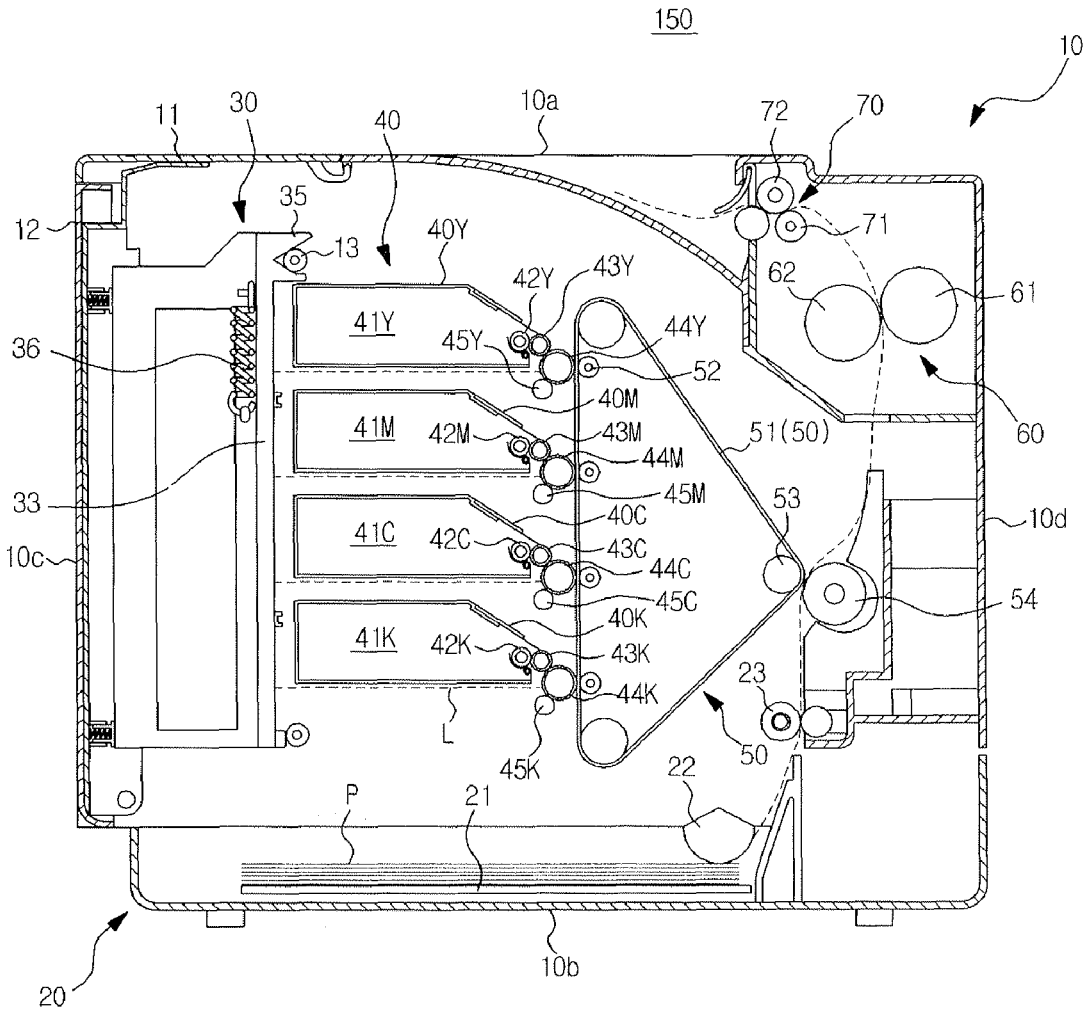
FIG. 1 is a sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below to explain the present general inventive concept by referring to the figures.

Figure 2:
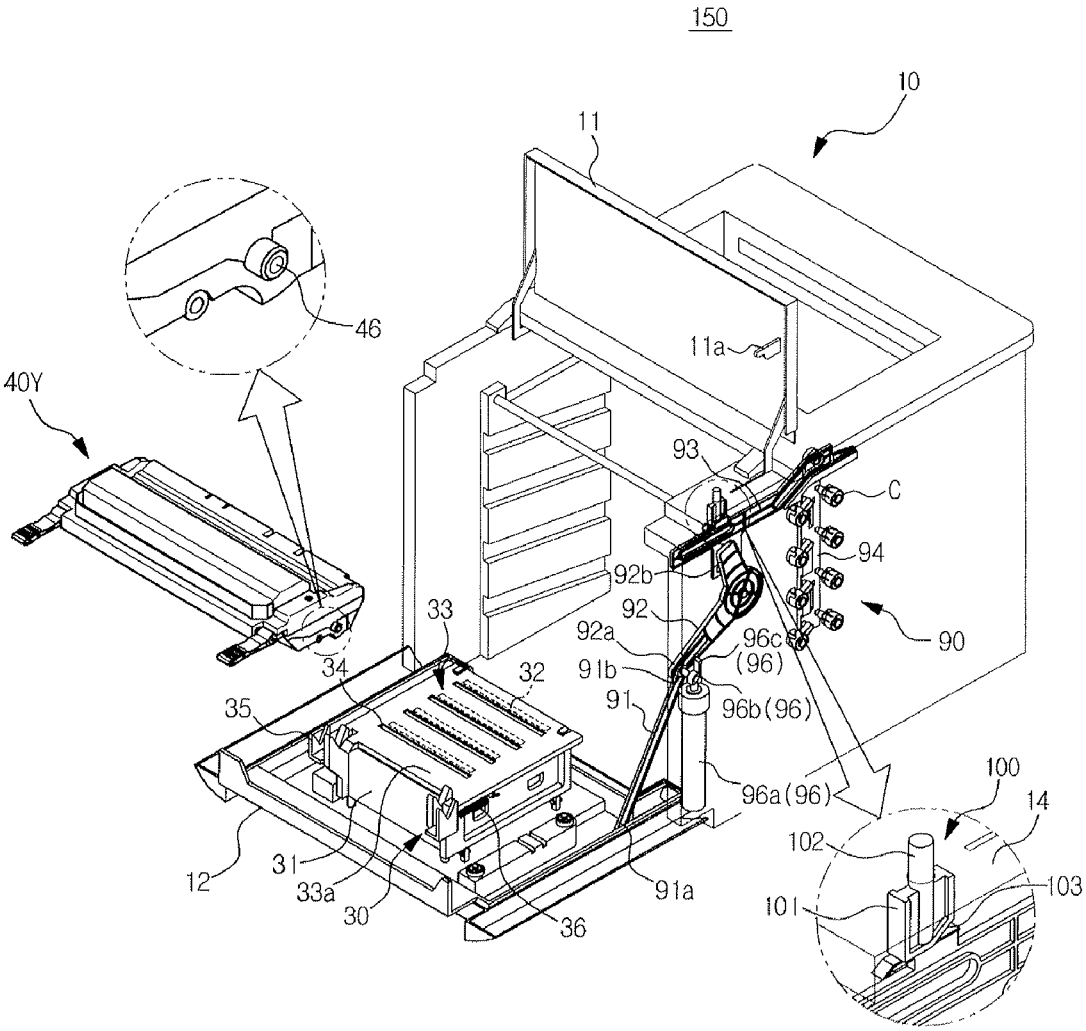
FIG. 2 is a perspective view illustrating an opening state of first and second covers of the image forming apparatus according to an embodiment of the present general inventive concept.

FIG. 1 is a sectional view illustrating an image forming apparatus 150 according to an embodiment of the present general inventive concept, and FIG. 2 is a perspective view illustrating an opening state of first and second covers of the image forming apparatus 150 according to an embodiment of the present general inventive concept.

As illustrated in FIGS. 1 and 2, the image forming apparatus 150 includes an apparatus body 10, a print media supply unit 20, a light scanning unit 30, a developing unit 40, a transfer unit 50, a fusing unit 60, and a print media discharge unit 70.

The apparatus body 10 forms the external appearance of the image forming apparatus. Also, the apparatus body 10 supports various components (units) disposed in the apparatus body 10. The apparatus body may have a top portion 10*a*, a bottom portion 10*b*, and one or more side portions 10*c* and 10*d*.

A first cover 11 and a second cover 12 are rotatably mounted at the top portion 10*a* and side portion 10*c* of the apparatus body 10, respectively. The first and second covers 11 and 12 may partially open and close the apparatus body 10 such that a user can approach the interior of the apparatus body 10.

The user may access at least one of the print media supply unit 20, the light scanning unit 30, the developing unit 40, the transfer unit 50, the fusing unit 60, and the print media discharge unit 70, through openings of the top and side portions 10*a* and 10*c*. The opening of the top side 10*a* may be formed to be connected to the opening of the side portions 10*c* such that the openings of the top portion 10*a* and the side portion 10*c* form a single opening which can be open and closed by the first cover 11 and the second cover 12, as illustrated in FIG. 2. However, it is possible that the openings of the top side 10*a* and the side portion 10*c* may be separate from each other by a portion of the apparatus body 10 disposed between the openings, such that a user can access the interior of the apparatus body 10, for example, at least two corresponding units, through corresponding ones of two separate openings of the top portion 10*a* and the side portion 10*c*. In this case, the exterior surface of the apparatus body 10 may be include the openings to correspond to the first and second covers 11 and 12 and the portion disposed between the two openings.

Although FIGS. 1 through 2 illustrates an opening to correspond to one cover, it is possible that the apparatus body 10 can have one or more openings formed on the apparatus body 10 to correspond to the one cover. It is also possible that three openings can be formed on the apparatus body 10 and three covers can be attached to the apparatus body 10 to correspond to the respective openings. In this case, one of three covers corresponds to the second cover 12 and two of the three covers correspond to the first cover 11. Therefore, two switches can be provided to communicate with the respective first covers, and two safety devices can be provided to control the respective switches in response to movements of the second cover and a link unit (described later) connected to the second device.

When one of three covers corresponds to the first cover 11, two of the three covers correspond to the second cover 12.

Therefore, only one switch and one safety device can be provided to communicate with the first cover, and the link unit may be provided to move according to movement (opening or closing operation) of the two covers. That is, the link unit may have a structure to move according to movements of the two second covers. When one of the two second covers does not move, the link unit does not move. When the two second covers move, the link unit moves to control the safety device and the first cover. The structure of the link unit may include a first link having two portions connected to the respective two second covers to control the safety device according to the two movements of the two first covers.

In an operation of opening the first cover 11 and the second cover 12, the user opens the first cover 11 first, and then opens the second cover 12 such that the second cover 12 having the light scanning unit 30 coupled to the rear thereof can be easily rotated. When closing the first cover 11 and the second cover 12, the user closes the second cover 12 first, and then closes the first cover 11.

The light scanning unit 30 may be detachably attached to the second cover 12. When the second cover 12 is in a closing position, the light scanning unit 30 is in an operating position to perform a scanning operation to emit light to scan a photoconductor of the developing unit 40. When the second cover 12 is in an opening position, the light scanning unit 30 is in a non-operating position to prevent the scanning operation.

Figure 3:
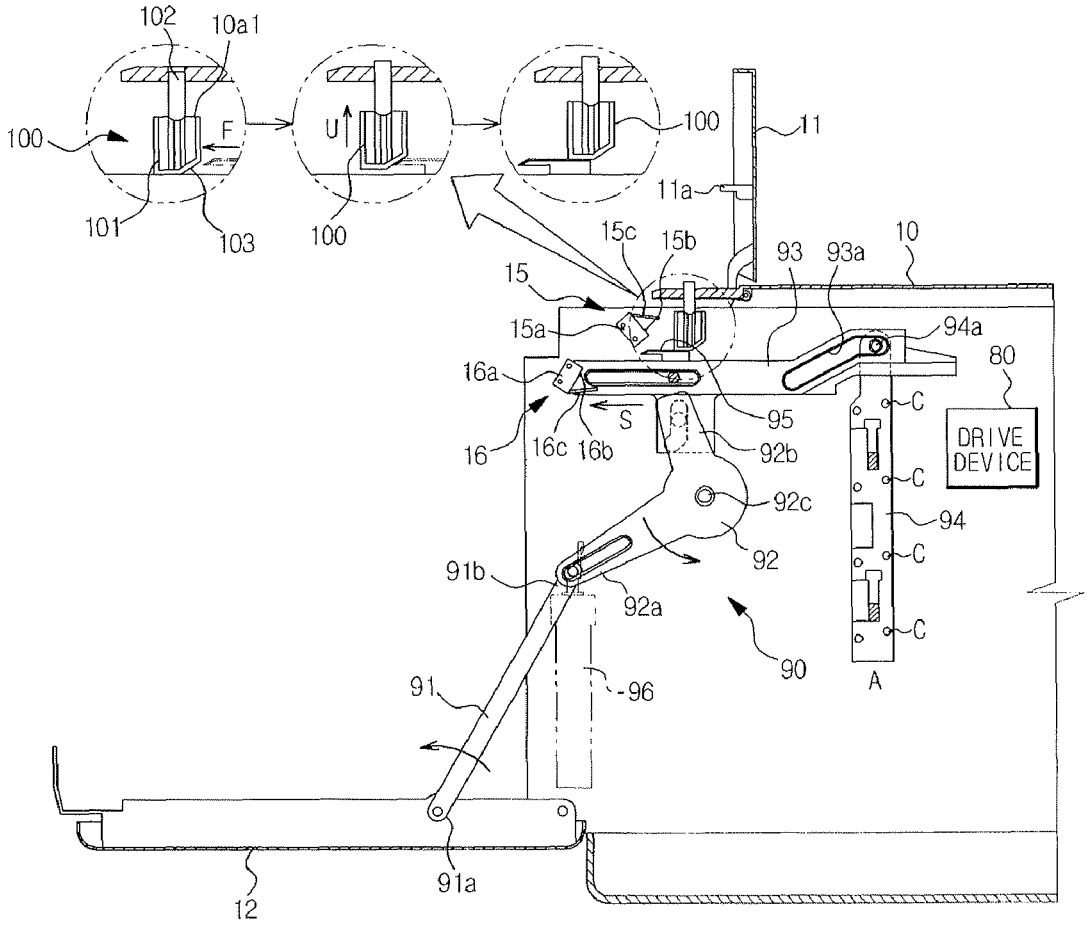
FIGS. 3 to 5 are side views illustrating an opening and closing structure of the first cover and the second cover according to the embodiment of the present general inventive concept.

Referring to FIG. 3, a first switch 15 is provided on a portion of the apparatus body 10 to be turned on/off according to the opening and closing operation of the first cover 11, and a second switch 16 is provided on another portion of the apparatus body 10 to be turned on/off according to the opening and closing operation of the second cover 12.

The first switch 15 and the second switch 16 include frames 15*a* and 16*a* having contact points 15*b* and 16*b* and push plates 15*c* and 16*c* configured to be pushed by an external force such that the push plates 15*c* and 16*c* are brought into contact with the contact points 15*b* and 16*b*, respectively. The push plates 15*c* and 16*c* may be made of an elastic material. Consequently, when the external force applied to the push plates 15*c* and 16*c* is removed, the contact between the push plates 15*c* and 16*c* and the corresponding contact points 15*b* and 16*b* is released. When closing the first cover 11 and the second cover 12, the push plate 15*c* of the first switch 15 and the push plate 16*c* of the second switch 16 are pushed by the closing operation of the first cover 11 and the second cover 12, such that the push plate 15*c* and the push plate 16*c* are brought into contact with the contact points 15*b* and 16*b* of the frames 15*a* and 16*a*. Consequently, power is supplied to a drive device according to the above described operation, or the supply of power to the drive device is interrupted according to the above described operation.

The first switch 15 may be a switch to generate a signal to be transmitted to the drive device 80 of the image forming apparatus 150, and the second switch 16 may be a switch to generate a signal to supply a high-voltage power to the light scanning unit 30 and the developing unit 40 of the image forming apparatus 150. The drive device 80 includes a drive motor (not illustrated) and a gear train (not illustrated). Drive units, such as an intermediate transfer belt 51, and developing rollers 43Y, 43M, 43C, and 43K of the developing unit 40, are driven by a drive force generated from the drive device 80.

The power generated from the drive device 80 is selectively supplied to corresponding units of the image forming apparatus, for example, at least one of the print media supply unit 20, the light scanning unit 30, the developing unit 40, the transfer unit 50, the fusing unit 60, and the print media discharge unit 70, according to a signal generated in an operation of at least one of the first switch 15 and the second switch 16.

Referring back to FIG. 1, the print media supply unit 20 includes a cassette 21 to store print media S, a pickup roller 22 to pick up the print media P, stored in the cassette 21, one by one, and a feed roller 23 to feed the picked-up print media P to the transfer unit 50.

The light scanning unit 30 is coupled to the rear of the second cover 12 in a structure in which the light scanning unit 30 is erected at the side of the apparatus body 10 during the operation of the image forming apparatus. As compared with the light scanning unit 30 being provided at the bottom of the image forming apparatus, the height of the image forming apparatus according to this embodiment is decreased, whereby the image forming apparatus is constructed in a more compact structure.

Referring to FIGS. 1 and 2, the light scanning unit 30 includes a case 31 coupled to the rear of the second cover 12, the case 31 having a scanning optical system (not illustrated) mounted therein, the case 31 having light windows 32 formed at one side thereof, and a shutter 33 to selectively open and close the light windows 32 according to the opening and closing operation of the second cover 12.

Light generated from the scanning optical system is scanned on photoconductors 44Y, 44M, 44C, and 44K, which will be described below, through the light windows 32 of the case 31 to form electrostatic latent images on the photoconductors 44Y, 44M, 44C, and 44K. For reference, reference numeral L of FIG. 1 indicates light generated from the scanning optical system to scan a corresponding one of the photoconductors 44Y, 44M, 44*c*, and 44K through the corresponding window 32.

The shutter 33 prevents foreign matter, such as dust, from being introduced into the case 31 of the light scanning unit 30 in a state in which the second cover 12 is open. The shutter 33 includes a plate 33*a* configured to slide along the case 31, slits 34 formed in the plate 33*a* at positions corresponding to the light windows 32 of the case 31, a matching member 35 provided at one side of the plate 33*a*, and an elastic member 36 to elastically support the plate 33*a* to one side.

When the second cover 12 is closed, the plate 33*a* slides to one side against an elastic force of the elastic member 36 by the interference between a matching rod 13 provided at the apparatus body 10 and the matching member 35, with the result that the light windows 32 of the case 31 are opened.

On the other hand, when the second cover 12 is opened, the interference between a matching rod 13 provided at the apparatus body 10 and the matching member 35 is released, with the result that the plate 33 is slid to the other side by the elastic force of the elastic member. At this time, the light windows 32 of the case 31 are closed.

The developing unit 40 includes four developing devices 40Y, 40M, 40C, and 40K to store different color developing agents, for example yellow (Y), magenta (M), cyan (C), and black (K) developing agents, respectively.

The respective developing devices 40Y, 40M, 40C, and 40K include developing agent storage parts 41Y, 41M, 41C, and 41K, supply rollers 42Y, 42M, 42C, and 42K, developing rollers 43Y, 43M, 43C, and 43K, and photoconductors 44Y, 44M, 44C, and 44K.

The photoconductors 44Y, 44M, 44C, and 44K are charged with a predetermined electric potential by charge rollers 45Y, 45M, 45C, and 45K before light is scanned from the light scanning unit 30.

The developing agent storage parts 41Y, 41M, 41C, and 41K store developing agents to be supplied to the photoconductors 44Y, 44M, 44C, and 44K. The supply rollers 42Y, 42M, 42C, and 42K supply the developing agents stored in the developing agent storage parts 41Y, 41M, 41C, and 41K to the developing rollers 43Y, 43M, 43C, and 43K. The developing rollers 43Y, 43M, 43C, and 43K fix the developing agents to the surfaces of the photoconductors 44Y, 44M, 44C, and 44K having electrostatic latent images formed thereon by the light scanning unit 30 to form visible images.

As illustrated in FIG. 2, the developing device 40Y includes a plurality of driven shafts 46 connected to couplings C provided at the apparatus body 10. In a state in which the developing device 40Y is mounted to the apparatus body 10, the driven shafts 46 of the developing device 40Y are connected to the couplings C of the apparatus body 10, such that a drive force from a drive motor (not illustrated) of the drive device 80 is transmitted to the driven shafts 46 of the developing device 40Y through the couplings C. The developing rollers 43Y, 43M, 43C, and 43K, the supply rollers 42Y, 42M, 42C, and 42K, and the photoconductors 44Y, 44M, 44C, and 44K are driven by the drive force of the driven shaft 46 and the drive motor. In the following, the yellow developing device 40Y will be described as an example. The other developing devices 40M, 40C, and 40K may be similar to the developing device 40Y. Therefore, detailed descriptions thereof will be omitted.

Referring to FIG. 1, the transfer unit 50 is one of the image carrier units, such as the photoconductors 44Y, 44M, 44C, and 44K. The transfer unit 50 includes an intermediate transfer belt 51, first transfer rollers 52, and a second transfer roller 53.

The first transfer rollers 52 face the photoconductors 44Y, 44M, 44C, and 44K, while the intermediate transfer belt 51 is located between the first transfer rollers 52 and the photoconductors 44Y, 44M, 44C, and 44K, to transfer the visible images formed on the photoconductors 44Y, 44M, 44C, and 44K to the intermediate transfer belt 51.

The second transfer roller 53 faces a support roller 54, while the intermediate transfer belt 51 is located between the second transfer roller 53 and the support roller 54, to transfer the image on the intermediate transfer belt 51 to the print media S passing the transfer belt 51 and support roller 54.

The fusing unit 60 includes a heat roller 61 having a heat source and a press roller 62 disposed opposite to the heat roller 61. When print media pass between the heat roller 61 and the press roller 62, the image is fused to the print media by heat transmitted from the heat roller 61 and pressure acting between the heat roller 61 and the press roller 62.

The print media discharge unit 70, including a discharge roller 71 and a discharge backup roller 72, discharges the print media, passing through the fusing unit 60, out of the apparatus body 10.

The operation of the image forming apparatus with the above-stated construction will be described briefly. When a printing operation is commenced, the surfaces of the respective photoconductors 44Y, 44M, 44C, and 44K are uniformly charged by the charge rollers 45Y, 45M, 45C, and 45K. Light beams corresponding to image information of the respective colors are scanned on the surfaces of the uniformly charged photoconductors 44Y, 44M, 44C, and 44K through the slits 34 of the light scanning unit 30 corresponding to the respective photoconductors 44Y, 44M, 44C, and 44K, such that electrostatic latent images corresponding to the respective colors are formed on the photoconductors 44Y, 44M, 44C, and 44K.

A developing bias potential is applied to the developing rollers 43Y, 43M, 43C, and 43K of the respective developing devices 40Y, 40M, 40C, and 40K, such that developing agents are attached to the respective photoconductors 44Y, 44M, 44C, and 44K to form visible images. The visible images are transferred to the intermediate transfer belt 51 via the first transfer rollers 52.

The image forming apparatus according to this embodiment is a tandem type image forming apparatus that is capable of simultaneously transferring visible images of yellow (Y), magenta (M), cyan (C), and black (K) to the intermediate transfer belt 51.

During the above-described process, the print media may be caught or jammed by the rollers, or the parts (units) of the image forming apparatus may be worn away. In this case, a user may open at least one of the first cover 11 and the second cover 12, and may remove the jammed print media or may separate the corresponding parts (corresponding units) from the apparatus body 10 or replace the corresponding parts with a new one thereof.

Hereinafter, the opening and closing structure of the first cover 11 and the second cover 12 according to this embodiment will be described with reference to the accompanying drawings.

Figure 4:
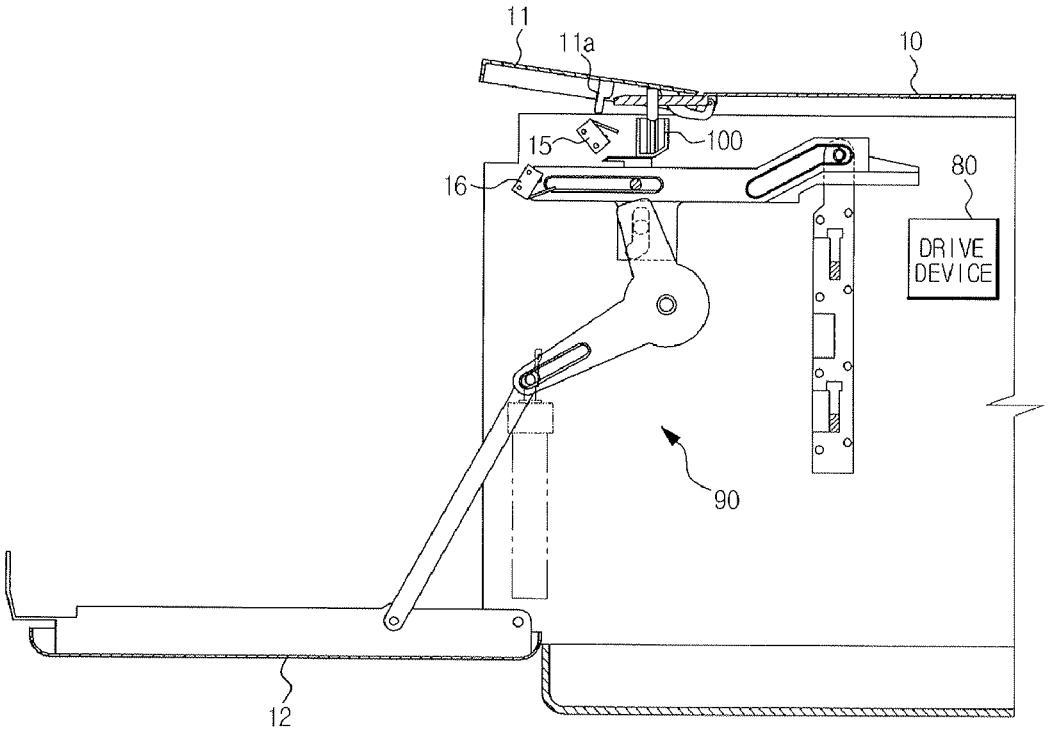
Figure 5:
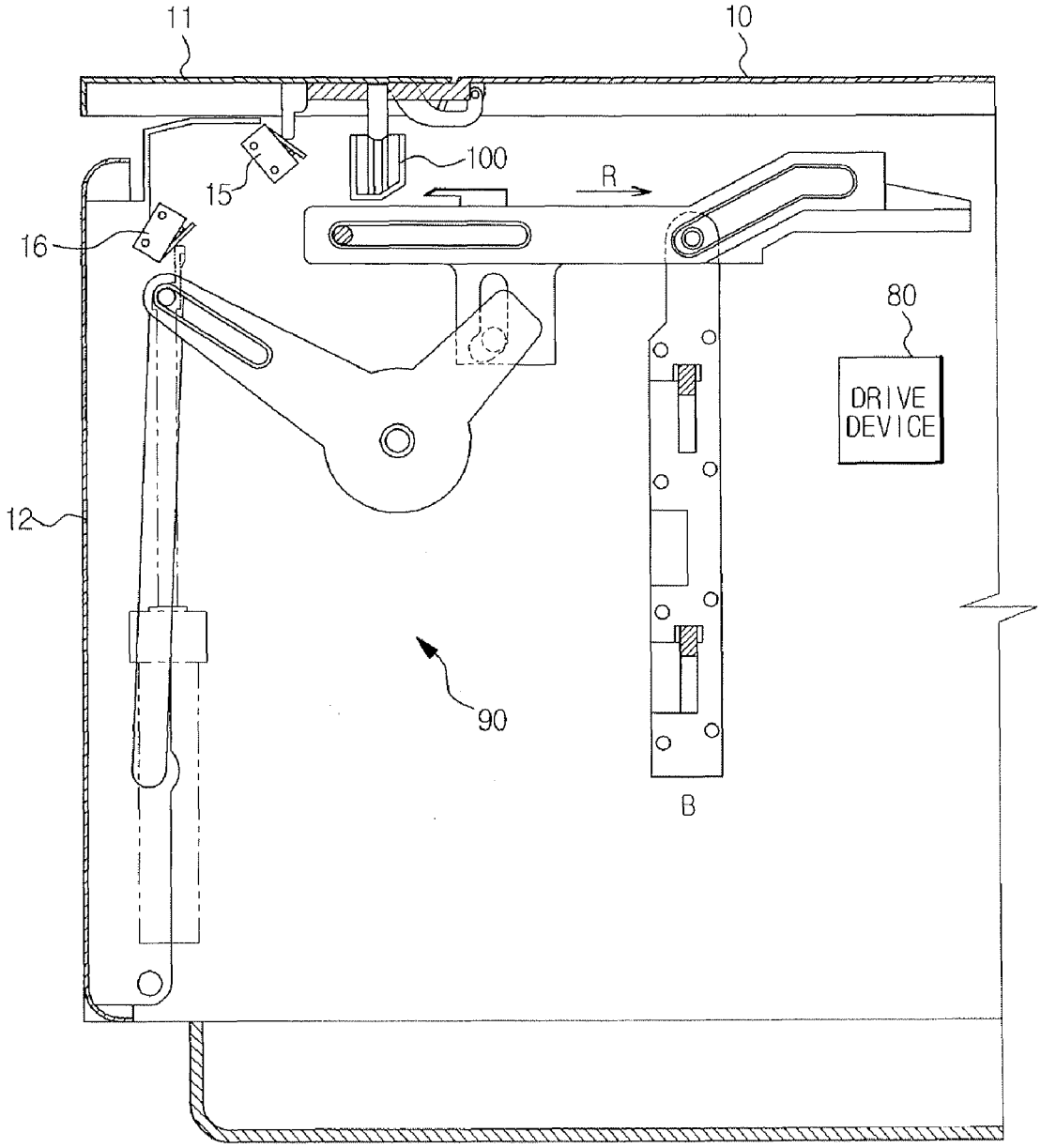

FIGS. 3, 4, and 5 are side views illustrating the opening and closing structure of the first cover 11 and the second cover 12 according to the embodiment of the present general inventive concept. FIG. 3 illustrates an opening state (operation) of the first cover 11 and the second cover 12, FIG. 4 illustrates a closing state (closing operation) of the first cover 11 while the second cover 12 is open, and FIG. 5 illustrates the closing operation of the first cover 11 while the second cover 12 is closed.

As illustrated in FIGS. 3, 4, and 5, the image forming apparatus 150 further includes a link assembly 90 operatively connected to the second cover 12, couplings C of FIGS. 2 and 3, and a damping member 96.

The link assembly 90 includes a first link 91 having one end 91*a* hingedly coupled to the second cover 12, a second link 92 having one end 92*a* hingedly coupled to the other end 91*b* of the first link 91 to perform a rotation, a third link 93 connected to the other end 92*b* of the second link 92 to perform a back-and-forth motion, and a fourth link 94 connected to the third link 93 to perform an up-and-down motion.

The second link 92 is supported by the apparatus body 10 through a shaft 92*c* such that the second link 92 can rotate with respect to the shaft 92*c*.

The third link 93 is supported by the apparatus body 10 such that the third link 93 can rectilinearly move back and forth. The third link 93 has an incline groove 93*a* formed at one side thereof. Unexplained reference numeral 95 indicates a lifter provided at the third link 93. The lifter 95 moves back and forth along with the third link 93 to move a safety device 100, which will be described below, up and down.

The fourth link 94 has a protrusion 94*a* corresponding to the incline groove 93*d* of the third link 93. The fourth link 94 is supported by the apparatus body 10 such that the fourth link 94 can be moved up and down between a position A of FIG. 3 and a position B of FIG. 5 by the third link 93 moving back and forth. The fourth link 94 drives the couplings C provided at the apparatus body 10.

The couplings C are driven by a rotary force of the second cover 12 transmitted by the first link 91, the second link 92, the third link 93, and the fourth link 94, such that the couplings C are selectively connected to corresponding ones of the driven shafts 46 of the developing devices 40Y, 40M, 40C, and 40K. That is, when the second cover 12 is closed, the fourth link 94, operatively connected to the second cover 12, moves upward to drive the couplings C in one direction. As a result, the couplings C are connected to the driven shafts 46 of the developing devices 40Y, 40M, 40C, and 40K.

On the other hand, when the second cover 12 is opened, the fourth link 94, operatively connected to the second cover 12, moves downward to drive the couplings C in the other direction. As a result, the couplings C are disconnected from the driven shafts 46 of the developing devices 40Y, 40M, 40C, and 40K.

The damping member 96 includes a cylinder 96*a* supported by the apparatus body 10 and a rod 96*b* connected to the other end 91*b* of the first link 91 to move back and forth. A pneumatic damper or a hydraulic damper may be used as the damping member. Of course, the damping member may be a torsion spring.

Referring to FIGS. 2 and 3, the image forming apparatus 150 according to this embodiment further includes a safety device 100 operatively connected to the second cover 12 to selectively restrict the switch from being turned on by the first cover.

The safety device 100 includes a device body 101, a support part 102 provided at a side 10*a*1 of the device body 101 to selectively support the first cover 11, and an incline part 103 provided at a lower side of the device body 101 to slide along the lifter 95 of the third link 93.

As illustrated in FIG. 3, when the second cover 12 is opened after the first cover 11 is closed, the third link 93, operatively connected to the second cover 12, moves forward in a direction F, and the lifter 95 of the third link 93 moves the safety device 100 outward from the apparatus body 10 in a direction U. In other words, the incline part 103 of the safety device 100 slides along the lifter 95 of the third link 93, such that the safety device 100 moves upward in the direction U. Unexplained reference numeral 14 (see FIG. 2) indicates a guide provided at the apparatus body 10 such that the support part 102 of the safety device 100 passes through the guide 14. The guide 14 guides the up-and-down motion of the safety device 100.

However, the present general inventive concept is not limited thereto. The first cover 11 and the second cover 12 can be simultaneously opened. It is also possible that the second cover 12 moves to an opening position, then the first link 91 moves, the second link 92 rotate with respect to a shaft 92*c*, and the third link 93 slides in a direction S according to a structural relationship between a pin and a groove of the second link 92 and the third link 93, such that a lifter 95 pushes the device body 101 of the safety device 100. And, the fourth link 94 moves when a pin (protrusion) 94*a* moves along a groove 93*a* such that the couplings C can be selectively in a coupling position or a de-coupling position with the driven shaft 46 such that a driving power can be transmitted from the drive device 80 to the developing device 40Y, 40, M, 40C, and 40K.

Consequently, even when the first cover 11 is closed in a state in which the second cover 12 is open, as illustrated in FIG. 4, the closing operation of the first cover 11, i.e., the rotation of the first cover 11, is restricted by the safety device 100. Consequently, the first switch 15 is prevented from being turned on by the first cover 11, and therefore, the drive device 80 is prevented from operating. In other words, the safety device 100 has been moved upward in a state in which the second cover 12 is open. Consequently, the first cover 11 is supported by the support part 102 of the safety device 100, although the first cover 11 rotates by its own weight, such that the first cover 11 is prevented from being fully closed, whereby the first switch 15 is prevented from being turned on.

On the other hand, when the first cover 11 is closed after the second cover 12 is closed, as illustrated in FIG. 5, the first cover 11 is fully closed. At this time, the first switch 15 is pressed by a press part 11*a* provided at a rear portion of the first cover 11, such that the first switch 15 is turned on. The second switch 16 is pressed by an end 96*c* of the rod 96*b* of the damping member 96, operatively connected to the second cover 12 which is in an opening position, such that the second switch 16 is turned on.

Specifically, when the second cover 12 is closed, the third link 93, operatively connected to the second cover 12, moves backward in a direction R, and the safety device 100, supported by the lifter 95 of the third link 93, moves downward in a direction D, with the result that the first cover 11 is normally closed. At this time, the second switch 16 is turned on first by the second cover 12, and then the first switch 15 is turned on by the first cover 11, with the result that power is supplied to the developing unit 40, the light scanning unit 30, and the drive device 80.

Even when the first cover 11 is closed, in a state in which the second cover 12 is open, due to external unexpected impact or carelessness of a user, as described above, the first switch 15 is prevented from being turned on by the first cover 11, and therefore, the drive device 80 is prevented from operating. Consequently, the occurrence of an accident, such as injury to fingers of the user by the sudden operation of the intermediate transfer belt 51, is prevented, whereby the safety of the image forming apparatus is improved.

Also, foreign matter is prevented from being introduced to the intermediate transfer belt 51, whereby the damage to the internal parts of the image forming apparatus due to the foreign matter is prevented.

Figure 6:
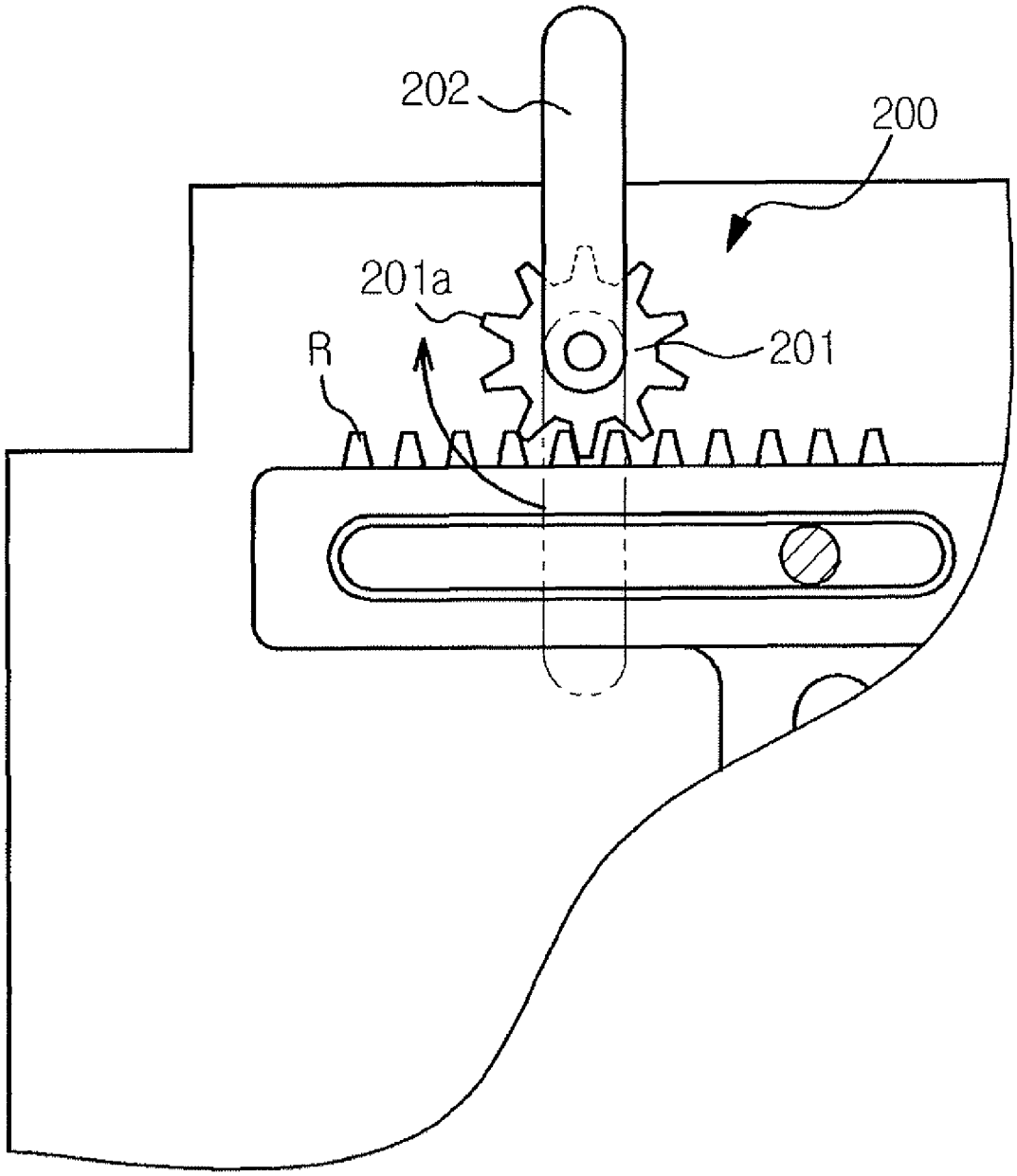
FIGS. 6 to 8 are side views illustrating safety devices according to an embodiment of the present general inventive concept.
Figure 7:
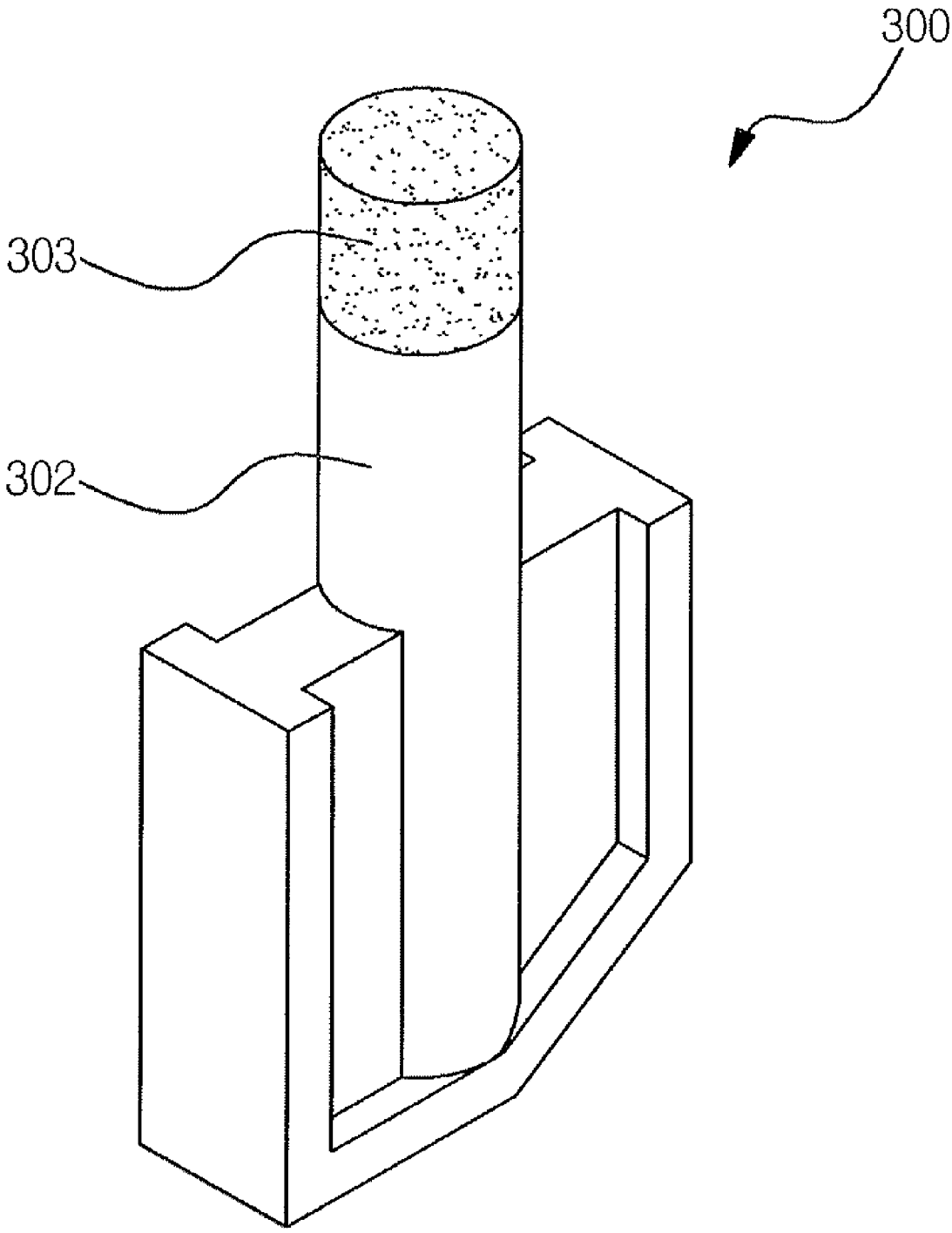
Figure 8:
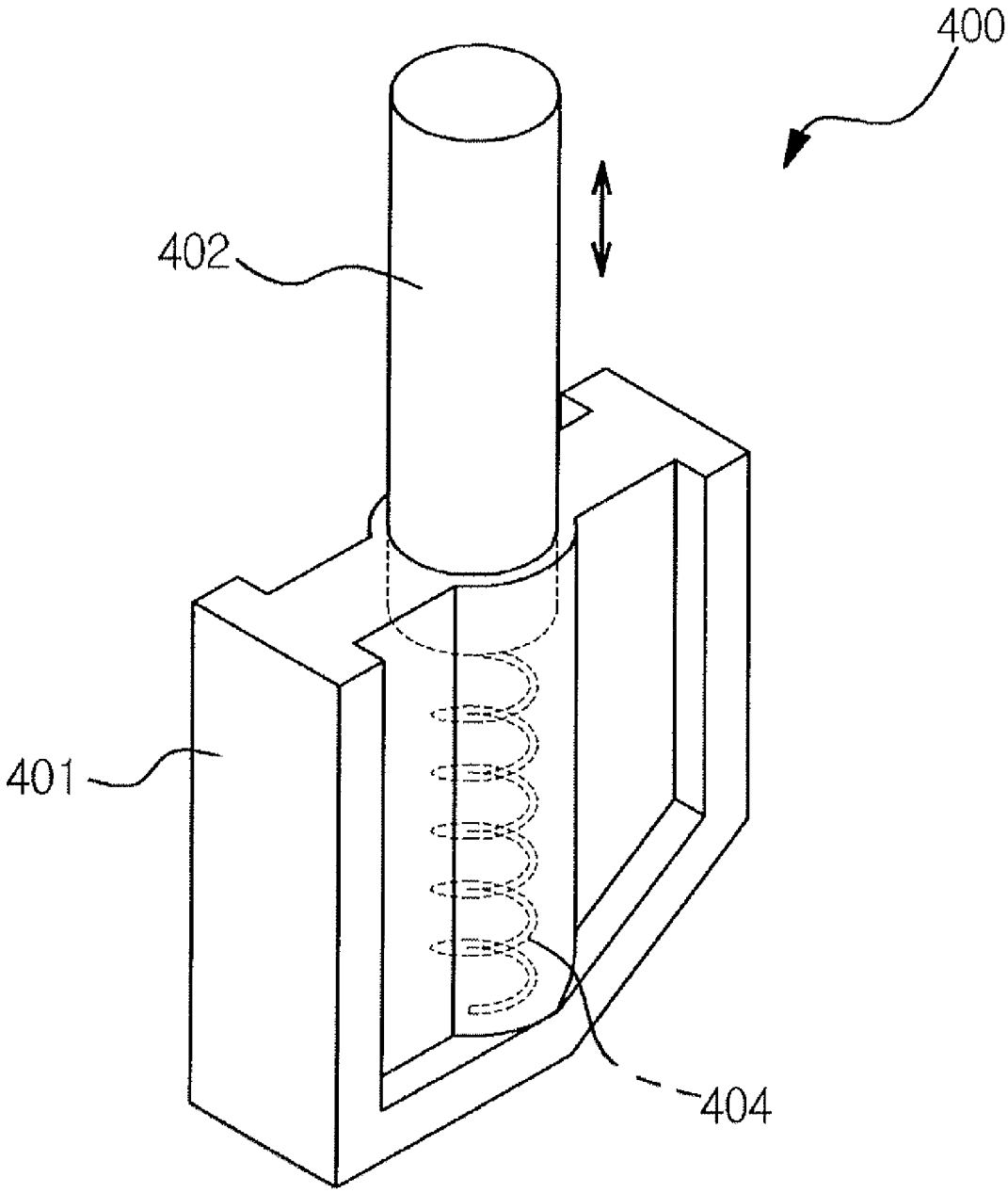

FIGS. 6, 7, and 8 are side views illustrating safety devices according to an embodiment of the present general inventive concept. For reference, elements shown in FIGS. 6 to 8, which are identical or similar to those of the previous embodiment, are denoted by the same reference numerals, and the description of the previous embodiment may be equally applied to the modifications as long as there is nothing in particular to mention. Therefore, the description and illustration thereof will not be given.

As illustrated in FIG. 6, a safety device 200 includes a rotary part 201 supported by the apparatus body 10, the rotary part 201 having a gear 201*a* formed at the outer circumference thereof, and a support part 202 provided at one side of the rotary part 201 to selectively support the first cover 11. The gear 201*a* of the rotary part 201 corresponds to a rack gear R formed at the third link 93.

When the second cover 12 is opened, the third link 93 moves forward, the rotary part 201 is rotated to one side by the rack gear R of the third link 93, and the support part 202 is directed to the upper side of the apparatus body 10. Consequently, even when the first cover 11 is closed in a state in which the second cover 12 is open, the first switch 15 is prevented from being turned on by the first cover 11.

Also, as illustrated in FIG. 7, a safety device 300 may further include an anti-vibration member 303, made of an elastic material, attached to an end of a support part 302. Consequently, when the first cover 11 is closed by its own weight, impact and noise generated between the first cover 11 and the support part 302 are reduced. The anti-vibration member 303 may be connected to the side 10*a*1 of the safety device 100.

As illustrated in FIG. 8, a support part 402 of a safety device 400 may be elastically supported by a body part 401 of the safety device 400. Unexplained reference numeral 404 indicates a coil spring mounted at the body part 401 to elastically support the safety device 400.

In addition, the safety device may be modified in various other forms.

As apparent from the above description, the image forming apparatus has an effect in that the power interrupting structure and the cover opening and closing structure of the image forming apparatus are improved.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

an apparatus body;

a first cover and a second cover to open and close the apparatus body;

a switch configured to be turned on/off according to an opening and closing operation of the first cover;

a safety device, operatively connected to the second cover, to selectively restrict the switch from being turned on by the first cover;

a developing device having at least one driven shaft; and a back-and-forth moving link operatively connected to the second cover to perform a back-and-forth motion to connect or release the at least one driven shaft and at least one coupling.

2. The image forming apparatus according to claim 1, wherein:

the switch is turned on by the closing operation of the first cover; and the safety device restricts the closing operation of the first cover in a state in which the second cover is open.

3. The image forming apparatus according to claim 1, wherein the safety device selectively restricts a rotation of the first cover.

4. The image forming apparatus according to claim 1, wherein the safety device is operatively connected to the second cover to perform a rectilinear motion.

5. The image forming apparatus according to claim 1, wherein the safety device advances from the apparatus body when the second cover is opened, and the safety device retreats to the apparatus body when the second cover is closed.

6. The image forming apparatus according to claim 4, wherein the apparatus body includes a guide to guide the rectilinear motion of the safety device.

7. The image forming apparatus according to claim 1, wherein the safety device is operatively connected to the second cover to perform a rotation.

8. The image forming apparatus according to claim 1, wherein the safety device includes a device body and a support part provided at an upper side of the device body to selectively support the first cover.

9. The image forming apparatus according to claim 8, further comprising:

an anti-vibration member, made of an elastic material, attached to an end of the support part.

10. The image forming apparatus according to claim 8, wherein the support part is elastically supported by the body part.

11. The image forming apparatus according to claim 8, the safety device further comprising:

an incline part provided at a lower side of the device body to slide along a lifter of the back-and-forth moving link.

12. The image forming apparatus according to claim 11, wherein:

the at least one coupling is selectively connected to the at least one driven shaft of the developing device.

13. The image forming apparatus according to claim 11, further comprising:

a rotary link, having one end connected to the second cover and the other end connected to the back-and-forth moving link, to transmit a rotary force of the second cover to the back-and-forth moving link.

14. The image forming apparatus according to claim 13, further comprising:

a damping member connected to the back-and-forth moving link and the rotary link to damp a rotation of the second cover.

15. The image forming apparatus according to claim 1, wherein power supplied to a drive device is turned on/off by the switch.

16. The image forming apparatus of claim 1, further including another switch, wherein when the first cover is closed after the second cover is closed, both switches are turned on to provide power to at least two of a developing device, a light scanning device, and a drive device.

17. The image forming apparatus of claim 1, wherein, when the first cover is closed and the second cover is opened, the switch is prevented from being turned on by the first cover.

18. An image forming apparatus comprising:

an apparatus body;

a first cover and a second cover to open and close the apparatus body;

a drive device to which power is supplied or the supply of power is interrupted according to the an opening and closing operation of the first cover;

a safety device configured to restrict a rotation of the first cover, in a state in which the second cover is open, to prevent power from being supplied to the drive device;

a developing device having at least one driven shaft; and a back-and-forth moving link operatively connected to the second cover to perform a back-and-forth motion to connect or release the at least one driven shaft and at least one coupling.

19. The image forming apparatus according to claim 18, wherein the safety device is operatively connected to the second cover.

20. The image forming apparatus according to claim 19, further comprising:

a first link having one end hingedly coupled to the second cover;

a second link having one end hingedly coupled to the other end of the first link to perform a rotation;

the back-and-forth link connected to the other end of the second link to perform the back-and-forth motion; and a fourth link connected to the back-and-forth link to perform an up-and-down motion, wherein the safety device slides along a lifter provided at the third link to move upward and downward.

21. The image forming apparatus according to claim 20, further comprising:

an attaching and detaching member configured to be attached to or detached from the apparatus body; and a coupling selectively connected to the attaching and detaching member, wherein the coupling is connected to the fourth link.

22. The image forming apparatus according to claim 20, further comprising:

a switch configured to be pushed by the first cover to be turned on/off.

23. An image forming apparatus comprising:

an apparatus body;

a first cover and a second cover to open and close the apparatus body;

a safety device configured to restrict a movement of one of the first cover and the second cover when the other one of the first cover and the second cover is open;

a developing device having at least one driven shaft; and a back-and-forth moving link operatively connected to the second cover to perform a back-and-forth motion to connect or release the at least one driven shaft and at least one coupling.

24. An image forming apparatus comprising:

an apparatus body having one or more openings and one or more units disposed therein to form an image on a printing medium, the one or more units including a developing device having at least one driven shaft;

a first cover and a second cover to open and close the one or more openings of the apparatus body to allow a user to access at least one of the one or more units through the one or more openings;

a drive device to supply power to at least one of the one or more units, including the developing device;

a link unit to move according to movements of the first cover and the second cover, and to control the drive device to selectively supply the power, the link unit including a back-and-forth moving link operatively connected to the second cover to perform a back-and-forth motion to connect or release the at least one driven shaft and at least one coupling, and wherein, in addition to the link unit, at least one of the one or more units is disposed on the one of the first cover and the second cover and moves together with the one of the first cover and the second cover between an operating position where the units form the image and a non-operating position where the units do not form the image.

25. The image forming apparatus of claim 24, further comprising:

a switch disposed to selectively operate according to the movement of the link unit; and a safety device disposed between the switch and the one of the first cover and the second cover to control a communication between the switch and the one of the first cover and the second cover.

* * * * *